United States Patent [19]

Shinagawa et al.

[11] Patent Number: 4,954,419

[45] Date of Patent: Sep. 4, 1990

[54] DIFFUSION TRANSFER PHOTOGRAPHIC FILM UNIT

[75] Inventors: Yukio Shinagawa; Toru Oikawa; Junichi Yamanouchi; Kentaro Shiratsuchi, all of Kanagawa, Japan

[73] Assignee: Fuji Photo Film Co., Ltd., Kanagawa, Japan

[21] Appl. No.: 333,228

[22] Filed: Apr. 5, 1989

[30] Foreign Application Priority Data

Apr. 6, 1988 [JP] Japan ..... 63-84666
Jun. 23, 1988 [JP] Japan ..... 63-155934

[51] Int. Cl.[5] ..... G03C 5/54; G03C 1/90

[52] U.S. Cl. ..... 430/215; 430/262; 430/263

[58] Field of Search ..... 430/215, 262, 263

[56] References Cited

U.S. PATENT DOCUMENTS 4,366,227 12/1982 Berger et al. ..... 430/263
4,401,746 8/1983 Pfingston ..... 430/262
4,629,677 12/1986 Katoh ..... 430/263

*Primary Examiner*—Richard L. Schilling
*Attorney, Agent, or Firm*—Sughrue, Mion, Zinn, MacPeak & Seas

[57] ABSTRACT

A diffusion transfer photographic film unit comprising a support having thereon outwardly from said support (a) a dye image receiving layer; (b) a first peeling layer containing a copolymer of at least (i) an ethylenically unsaturated monomer containing at least one hydrocarbon group containing from 7 to 18 carbon atoms, and (ii) an ethylenically unsaturated monomer, the homopolymer of which is soluble in water or an aqueous alkaline solution; (c) a second peeling layer containing a cellulose ester; and (d) a light-sensitive silver halide emulsion layer containing a light-sensitive silver halide and a dye image forming substance. The diffusion transfer photograph produced using the unit of the invention has stable peeling properties, is not sticky, and is excellent in scratch resistance.

20 Claims, No Drawings

DIFFUSION TRANSFER PHOTOGRAPHIC FILM UNIT

FIELD OF THE INVENTION

This invention relates to a diffusion transfer photographic film unit, and more particularly to a silver salt diffusion transfer photographic film unit and a color diffusion transfer photographic film unit which have a plurality of peeling layers and allows an image-receiving layer to be completely separated from the remainder of the film unit after processing.

BACKGROUND OF THE INVENTION

Conventional silver salt diffusion transfer photographic film units and color diffusion transfer photographic film units can be classified roughly into a peeling type which requires a peeling stage to view images, and a non-peeling type which can dispense with the peeling stage.

The peeling type includes a type (hereinafter referred to as a "peel-apart" type) and a color diffusion transfer film unit (hereinafter referred to as a "peelable monosheet" type) as diffusion transfer photographic film units. In the peel-apart type, a sensitive layer and a dye image receiving layer are separately coated on separate supports, respectively, a sensitive element and the dye image receiving element are superposed after the exposure of an image, a processing composition is spread therebetween and the dye image receiving element is then peeled off, whereby a dye image transferred to the dye image receiving layer is obtained on the side to be peeled. In the peelable monosheet type, at least an image receiving layer, a peeling layer and a sensitive element in this order are provided on the same support and the image receiving layer is peeled off from the peeling layer after an alkaline processing composition is applied for development. Diffusion transfer photographic film units of the peelable monosheet type provides a high-quality image obtained by peeling type color diffusion film units as well as an excellent handleability of non-peeling type color diffusion film unit as well as the excellent handleability provided by non-peeling type color diffusion transfer photographic film units.

However, these types have the disadvantages that the alkaline processing solution is sticky on the surface of the image and is liable to adhere to the surrounding zones after peeling, and the used film is not convenient to handle. Further, there is the disadvantage that the peeling layer is broken when being peeled off and the broken peeling layer is randomly deposited on the surface from which the peeling layer has been peeled.

The non-peeling type include a type in which an image receiving layer and a silver halide emulsion layer are provided on the same transparent support and a type where the image receiving layer and emulsion layer are provided on separate supports, although in the non-peeling type dye image receiving layer and the silver halide emulsion layer are provided between the transparent support and the other support. In the former case, a white light reflecting layer is provided between the image receiving layer and the silver halide emulsion layer, while in the latter case, a white pigment is incorporated in a processing composition to be spread between the image receiving layer and the silver halide emulsion layer, whereby a dye image transferred to the image receiving layer can be viewed by reflected light.

However, when the used emulsion, pod, and cover sheet are left un-peeled, the resulting print is too thick. Hence, peeling them off has been proposed. These conventional techniques are described in JP-A-47-8237, JP-A-59-220727, JP-A-59-229555, JP-A-56-65133, JP-A-45-24075, JP-A-49-4653, JP-A-49-4334, U.S. Patents 3,658,524, 3,227,550 and 4,359,518. However, problems are caused since the alkaline processing solution is sticky on the surface of the image and is liable to adhere to the surroundings after peeling; the used film is not convenient to handle; and the peeling layer is broken when peeled and the broken peeling layer is randomly deposited on the surface which has been peeled.

Other problem of the peeling type color diffusion transfer photographic film unit ,including both the peel apart type and the peelable monosheet type as well as a type in which the unnecessary part of the non-peeling type can be peeled, is that sharpness is lowered, when the space between the image receiving layer and the sensitive element is increased. However, when the distance between the sensitive layer and the image receiving layer is 10 μm or shorter, the problem exists that a cyan coloring material contained in the sensitive layer is dissolved in the alkaline developing solution and diffused during development and the image receiving layer is fogged.

Examples of materials for the peeling layers of the diffusion transfer photographic film unit include water-soluble or hydrophilic polymers such as gum arabic (U.S. Pat. Nos. 2,759,825 and 4,009,031), hydroxymethyl cellulose (U.S. Pat. No. 2,759,825 and JP-A-47-8237), methyl cellulose, ethyl cellulose and nitrocellulose (U.S. Pat. No. 2,759,825), cellulose acetate (Canadian Pat. No. 681,777), cellulose acetate hydrogen phthalate (Canadian Pat. No. 681,777), carboxymethylcellulose (U.K. Pat. No. 2,012,064), cellulose derivatives [JP-B-45-24075 (the term "JP-B" as used herein means an "examined Japanese patent publication")], starch ether (JP-B-50-35820), galactomannan (U.K. Pat. No. 869,190), pectin (U.S. Pat. No. 2,759,825), phthalated gelatin (JP-B-45-24075, JP-A-54-74431, JP-A-54-126535), sodium alginate (U.S. Pat. No. 2,759,825), polyvinyl alcohol (U.S. Pat. No. 2,759,825, U.K. Pat. No. 2,012,064 and JP-B-45-24075), and polymethacrylic acid (U.S. Pat. No. 2,759,825).

Further, as the materials for the peeling layer include water-insoluble synthetic polymers such as vinyl acetate-maleic anhydride copolymer and methyl methacrylate-acrylic acid copolymer (JP-B-45-15902), barbituric acid-formalin condensate (JP-B-49-4333), hydantoinformalin condensate (JP-B-49-4334), and graft copolymers of gelatin fully reacted with anhydrous dicarboxylic acid, such as phthalic anhydride, and a monomer, such as a vinyl ester, a vinyl ether or an acrylic ester, or a mixture thereof (JP-A-56-65133).

Further, there has been proposed the use of a peeling layer composed of a terpolymer of styrene with acrylic acid (or methacrylic acid) and methyl methacrylate (or methyl acrylate), the terpolymer being dispersed in a water-soluble polymer such as hydroxyethyl cellulose (U.S. Pat. No. 4,366,227).

However, the peeling layers described in these patent publications still have problems with respect to failure in long-term stability during storage, failure in the formation of films, unevenness in the formed image, a powder depositing phenomenon (the deposited processing solution is crystallized on the surface of the image and the image becomes cloudy) and insufficient peeling property.

There have been proposed a method using an acrylic acid peeling layer disclosed in JP-A-60-214357 (the term "JP-A" as used herein means an "unexamined published Japanese patent application") and a method for providing temporarily a barrier against the alkaline processing solution in the photographic layer disclosed in JP-A-60-257446 and JP-A-60-257447. However, the coloring material in the sensitive layer is dissolved in the alkaline developing solution and diffused in the image receiving layer. Therefore, the selective diffusion of the coloring material in the image receiving layer can not be prevented, though the diffusion of the alkaline developing solution can be prevented.

However, the problem of stickiness of the surface of the image immediately after the peeling of the image receiving layer is still unsolved. There is a problem that when the surface of the image is touched with fingers immediately after peeling, fingerprints are left.

The color diffusion transfer photographic film unit has a problem that the coloring material contained in the sensitive layer is dissolved in the alkaline developing solution and diffused during development and, as a result, the image receiving layer is fogged and an image having a high minimum image density (Dmin) is obtained. As described above, when the distance between the sensitive layer and the image receiving layer is 10 μm or shorter, the coloring material contained in the sensitive layer is dissolved in the alkaline developing solution and diffused during development and the image receiving layer is fogged. Increasing the film thickness between the sensitive layer and the image receiving layer to prevent diffusion, causes a lowering of sharpness.

When the film thickness is kept to 10 μm or less, the coloring material cannot be prevented from being dissolved in the alkaline solution and being diffused and the scratch resistance of the image on the image receiving layer after peeling is lowered. Therefore, the surface of the image after peeling is easily damaged. Accordingly, a method is sought which solves several disadvantages.

SUMMARY OF THE INVENTION

An object of the present invention is to provide a diffusion transfer photograph which has stable peeling properties, does not become sticky and is excellent in scratch resistance and of high quality by a peeling type film unit which can be processed in room light.

Another object of the present invention is to provide a color diffusion transfer photograph which has stable peeling properties, does not become sticky, has a low minimum image density (Dmin) and is excellent in color reproducibility and scratch resistance and of high quality, by a peeling type film unit which can be processed in room light.

It has now been found that those and other objects of the invention are attained by a diffusion transfer photographic film unit (hereinafter sometimes referred to as film unit) comprising a support having thereon outwardly from said support (a) a dye image receiving layer; (b) a first peeling layer containing a copolymer of at least (i) an ethylenically unsaturated monomer containing at least one hydrocarbon group containing from 7 to 18 carbon atoms, and (ii) an ethylenically unsaturated monomer, the homopolymer of which is soluble in water or an aqueous alkaline solution; (c) a second peeling layer containing a cellulose ester; and (d) a light-sensitive silver halide emulsion layer containing a light-sensitive silver halide and a dye image forming substance.

DETAILED DESCRIPTION OF THE INVENTION

After exposure, the film unit of the present invention is treated by a pressing member to thereby uniformly spread the alkaline processing composition within the film unit, whereby development is initiated. After the spreading of the processing composition, the film unit may be placed in a light room or under daylight. After processing, the portion containing the support and the dye image receiving layer is peeled off from the remainder of the film unit at the position of the peeling layer. Thus, the used emulsion layer, pod, or the cover sheet are no longer attached. A print similar to a conventional print can be obtained.

In the present invention, the peeling layer is provided between the emulsion layer containing a dye image forming substance and the dye image receiving layer. After processing, the emulsion layer is peeled off. Accordingly, the peeling layers must be such that when the film unit is in an unprocessed state, the peeling layers keep the close contact of the image forming layer with the emulsion layer, while after processing, they can be easily peeled off.

The copolymer used for the first layer of the peeling layers of the present invention is conventionally known as a polymer for a neutralization layer, the copolymer containing at least a repeating unit derived from an ethylenically unsaturated monomer having at least a hydrocarbon group having from 7 to 18 carbon atoms and a repeating unit derived from an ethylenically unsaturated monomer whose homopolymer is soluble in water or an aqueous alkaline solution. The copolymer is used in the first peeling layer of the peeling layers in the present invention, this peeling layer being arranged at a position where the processing solution is spread, and the copolymer of the present invention does not cause substantial lowering of the alkalinity of the processing solution.

The ethylenically unsaturated monomer having at least a hydrocarbon group having from 7 to 18 carbon atoms according to the present invention is now described in detail.

One monomer of the copolymer according to the present invention is represented by formula (I).

$$CH_2{=}CR_1R_2 \qquad (I)$$

In formula (I), RI represents hydrogen, a halogen atom, a cyano group or a substituted or unsubstituted alkyl group having from 1 to 4 carbon atoms. Examples of the alkyl group include methyl, ethyl and n-butyl. Among them, hydrogen and methyl are preferred.

$R_2$ represents a monovalent group having at least one hydrocarbon group $R_3$ having from 7 to 18 carbon atoms.

Preferably $R_2$ represents -13 $COOR_3$, $-CONHR_3$,

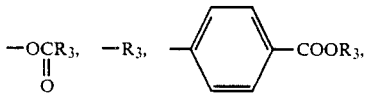

-continued

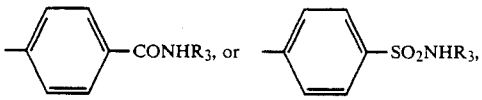

and more preferably —$COOR_3$.

Examples of the hydrocarbon group $R_3$ include an alkyl group having from 7 to 18 carbon atoms (e.g., n-octyl, 2-ethylhexyl, n-decyl, n-dodecyl, n-hexadecyl, n-octadecyl), an alkylene group (e.g., $CH_{2n}$, n=7, 8, 10, 14 or 16,

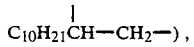

an aralkyl group (e.g.,

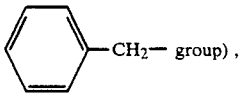

an aralkylene group

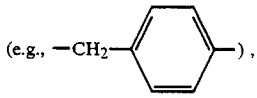

an aryl group (e.g., tolyl, 2-t-butylphenyl, 4-t-butylphenyl, 2,5-di-t-amylphenyl, 4-t-octylphenyl) and an arylene group

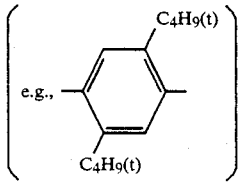

These groups may have further one or more substituent groups such as alkyl group, alkoxy group, aralkyl group, and aryl group.

Preferably $R_3$ is selected from the alkyl group having from 7 to 18 carbon atoms, the alkylene group and the aryl group, an alkyl group having from 8 to 12 carbon atoms being particularly preferred.

Preferred examples of the monomer of formula (I) include acrylic esters, methacrylic esters, substituted acrylamides, substituted methacrylamides, vinyl esters and substituted styrenes. Typical examples of the monomers of formula (I) include, but are not limited to, the following compounds.

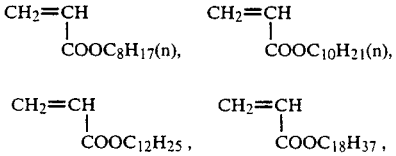

-continued

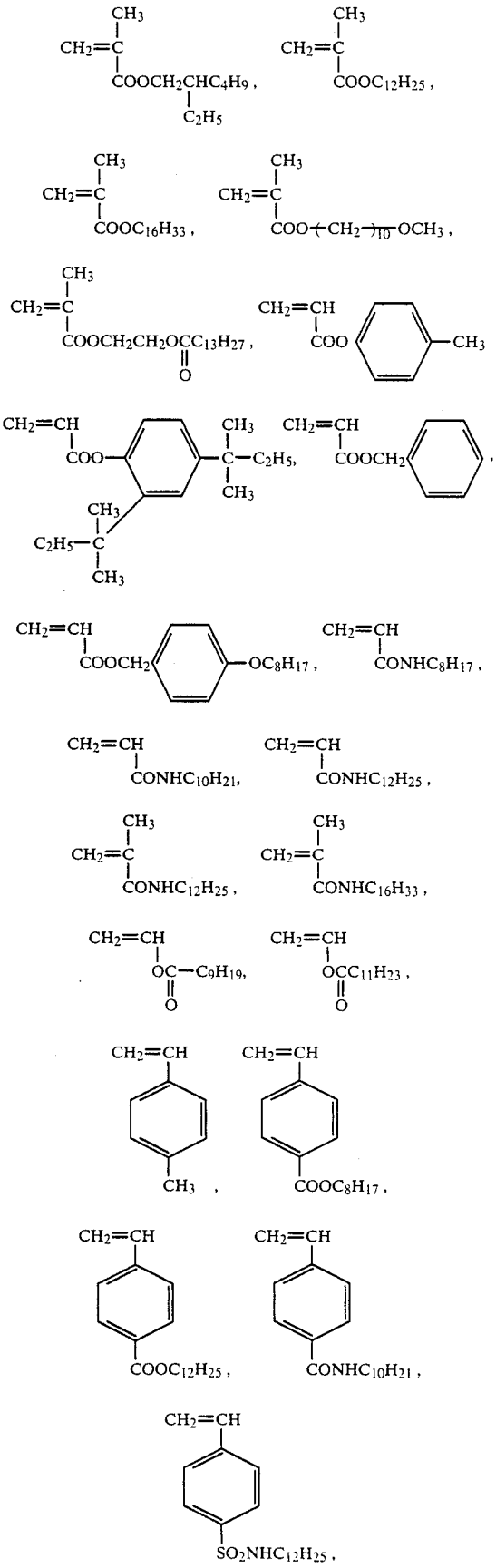

Preferably the monomer of formula (I) is selected from an alkyl acrylate and an alkyl methacrylate, in which the alkyl moiety has from 8 to 18 carbon atoms.

These monomer units as the components of the copolymers may be used either alone or a combination of two or more of them. These monomer units account for 10 to 90% by weight, preferably 20 to 80% by weight of the entire weight of the copolymer.

The ethylenically unsaturated monomer which constitutes a repeating unit of the copolymer of the present invention and whose homopolymer is soluble in water or an aqueous alkaline solution, is a monomer whose homopolymer at a concentration of 10% by weight or higher is soluble in distilled water or an aqueous solution of sodium hydroxide (1 mol/l).

The monomer is represented by formula (II):

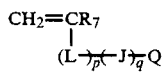

(II)

In the formula (II), R7 represents hydrogen, an alkyl group, preferably an alkyl group having from 1 to 4 carbon atoms (e.g., methyl, ethyl, propyl) or a halogen atom. Among them, hydrogen or a methyl group is preferred.

L represents —CONH—, —NHCO—, —COO—, —OCO—, —CO—, —$SO_2$—, —$NHSO_s$—, —$SO_2NH$ or —O—; —COO—, —CONH— and —CO— being preferred.

J represents an alkylene group, preferably an alkylene group having from 1 to 10 carbon atoms, which may be optionally substituted (e.g., methylene, ethylene, propylene, trimethylene, butylene, hexylene), an arylene group (which may be optionally substituted (e.g., phenylene), an aralkylene group, which may be optionally substituted (e.g.,

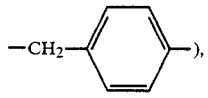

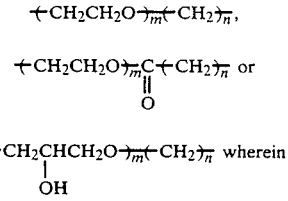

m represents an integer of from 0 to 40 and n represents an integer of from 0 to 4. Preferably, J represents an alkylene group having from 1 to10 carbon atoms,

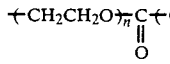

or phenylene.

Q represent

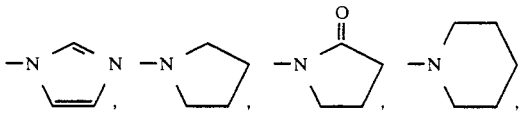

-continued

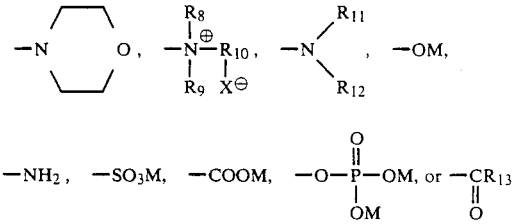

wherein M represents hydrogen or a cation; $R_{13}$ represents an alkyl group having from 1 to 4 carbon atoms (e.g., methyl, ethyl, propyl, butyl); $R_8$, $R_9$, $R_{10}$, $R_{11}$ and $R_{12}$, which may be the same or different, each represents hydrogen, an alkyl group having from 1 to 20 carbon atoms (e.g., methyl, ethyl, propyl, butyl, hexyl, decyl, hexadecyl), an alkenyl group (e.g., vinyl, allyl), a phenyl group (e.g. phenyl, methoxyphenyl, chlorophenyl) or an aralkyl group (e.g., benzyl); and X represents an anion.

The solubility of the monomer of formula (II) depends on the nature of Q.

In formula (II), p and q each represents 0 or 1.

Examples of the cation include alkali metal ions, alkaline earth metal ions and an ammonium ion. The monomers where Q is —COOM, —$NH_2$ or —$SO_3M$ are preferred, among which the monomers where Q is COOM are particularly preferred.

Typical examples of the ethylenically unsaturated monomers which constitute a repeating unit of the copolymer of the present invention and whose homopolymer is soluble in water or an aqueous alkaline solution, include, but are not limited to, the following compounds.

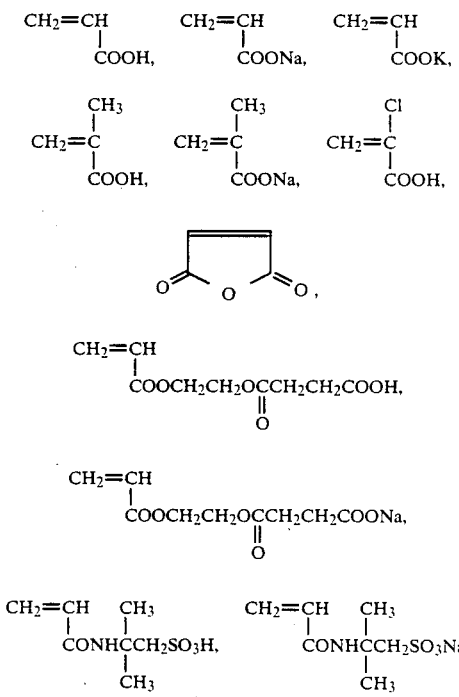

-continued

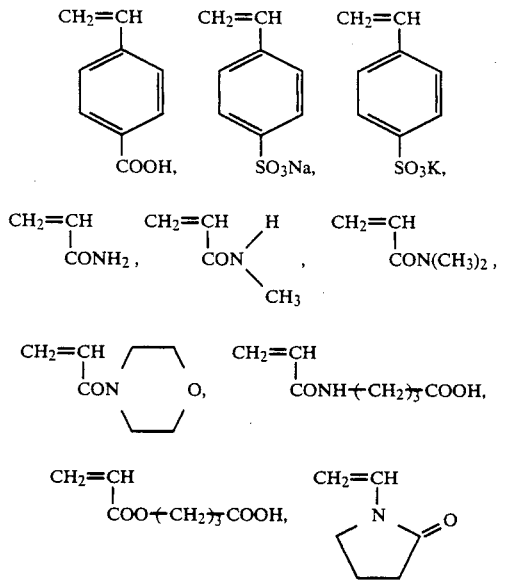

Preferably, the monomer of formula (II) is selected from acrylic acid, methacrylic acid, and the salts of these acids.

These constituent units may be used either alone or as a combination of two or more of them. The amount of the constituent unit varies depending on the average molecular weight of the copolymer, but accounts for 90 to 10% by weight, preferably 80 to 20% by weight of the entire weight of the copolymer.

The copolymer having at least a repeating unit derived from an ethylenically unsaturated monomer having at least a hydrocarbon group having from 7 to 18 carbon atoms and a repeating unit derived from an ethylenically unsaturated monomer whose homopolymer is soluble in water or an aqueous alkaline solution, may contain optionally further copolymerizable monomer components in addition to the above two repeating units. Preferred examples of the optional ethylenically unsaturated monomers include, but are not limited to, esters and amides derived from acrylic acid or u-alkylacrylic acids (e.g., methacrylic acid) [e.g., n-butylacrylamide, t-butylacrylamide, diacetonacrylamide, methyl acrylate, ethyl acrylate, n-propyl acrylate, n-butyl acrylate, t-butyl acrylate, iso-butyl acrylate, methyl methacrylate, ethyl methacrylate, n-butyl methacrylate, cyclohexyl methacrylate, 2-hydroxyethyl acrylate, 2-hydroxyethyl methacrylate, 2-methoxyethyl acrylate, 2-methoxyethyl methacrylate, 2-ethoxyethyl acrylate, 2-ethoxyethyl methacrylate, 2-butoxyethyl acrylate, 2-n-propyloxyethyl methacrylate, 2-(2-methoxy)ethoxyethyl acrylate], vinyl esters (e.g., vinyl acetate), acrylonitrile, methacrylonitrile, dienes (e.g., butadiene, isoprene), aromatic vinyl compounds (e.g., styrene), vinylidene chloride, vinyl alkyl ethers (e.g., vinyl ethyl ether), ethylene, propylene, 1-butene and isobutene.

These optional ethylenically unsaturated monomers may be used as a combination of two or more of them.

These optional monomer units as the components of the copolymer may be used either alone or as a combination of two or more of them. The amount of the optional monomer unit accounts for 30 to 0% by weight, preferably 20 to 0% by weight of the entire weight of the copolymer.

Preferred examples of the copolymers which can be used in the present invention include, but are not limited to, the following copolymers (the composition is represented by percentage by weight). These copolymder have a molecular weight preferably of from 5,000 to 1,000,000, more preferably of from 10,000 to 1,000,000.

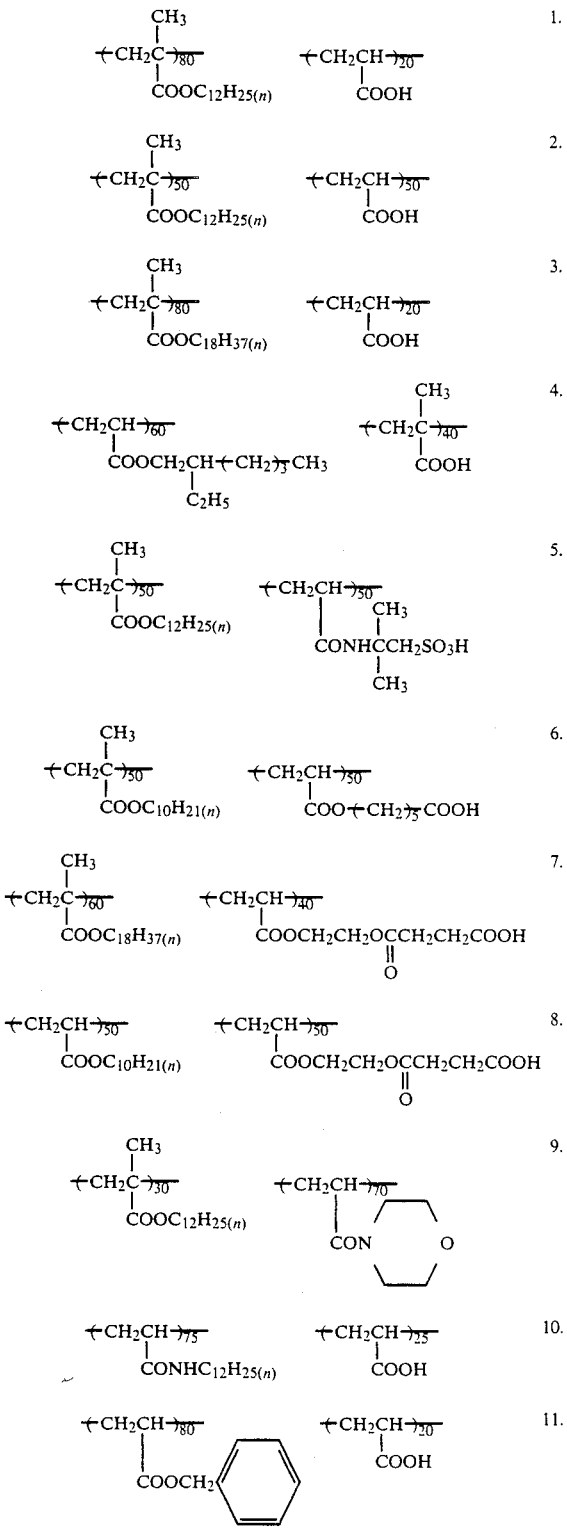

-continued

12.

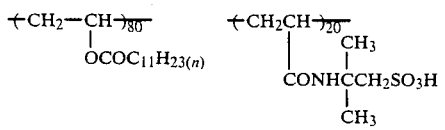

13.

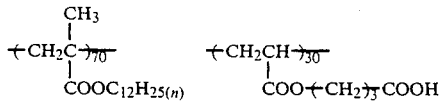

14.

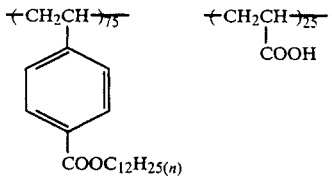

15.

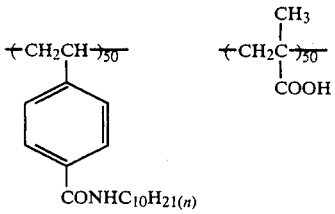

16.

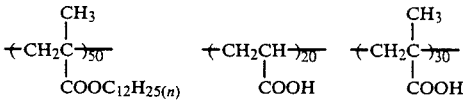

17.

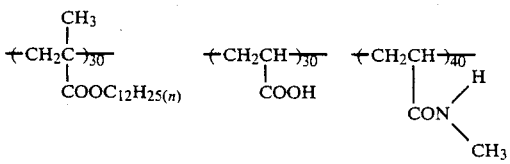

18.

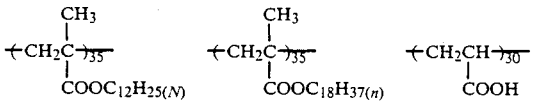

19

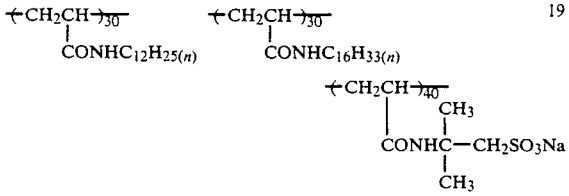

20.

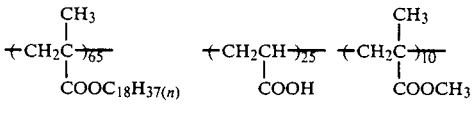

21.

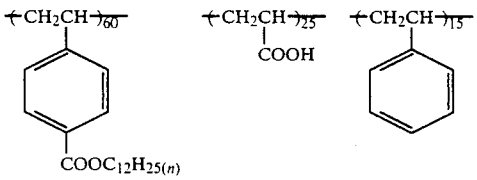

-continued

22.

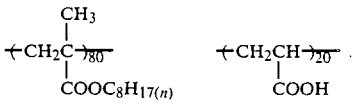

These compounds can be synthesized by any conventional methods, such as solution polymerization, emulsion polymerization, suspension polymerization, and precipitation polymerization. It is preferred that these compounds are synthesized by the solution polymerization method.

Synthesis Example of copolymer for the copolymer first peeling layer

Synthesis of acrylic acid-lauryl methacrylate copolymer (synthesis of the exemplified compound 1)

1000 ml of ethyl acetate and 290 ml of ethanol were placed in a 2l three-necked flask equipped with a stirrer, a reflux condenser, a dropping funnel, a mercury thermometer and a nitrogen gas-introducing pipe and heated in a hot water bath. When the temperature within the flask reached 70° C and stabilization was established, 1.6 g of 2,2'-azobis-(2,4-dimethylvaleronitrile) as a polymerization initiator was added thereto. A previously prepared monomer mixture of 320.0 g of lauryl methacrylate and 80.0 g of acrylic acid was slowly added dropwise thereto over a period of two hours. After completion of the addition, 1.6 g of the above-described polymerization initiator was added thereto. After two hours, additional 3.2 g of the polymerization initiator was added thereto. The mixture was then stirred at 70° C. for three hours to carry out a polymerization reaction. After completion of the heating and the stirring, the temperature within the flask was lowered to room temperature and the contents were taken out.

Yield: 1,490 g, the solid content of the polymer: 25.8 wt.%, viscosity: 14.5 cp (in mixed 20% solution of ethyl acetate/ethanol (weight ratio: 8/2), 25° C., E type viscometer).

The copolymer first peeling layer can be prepared by dissolving the copolymer in an organic solvent such as an alcohol (e.g., methanol, ethanol, propanol, ethylene glycol), acetone, methyl ethyl ketone, acetonitrile, dioxane, formamide, tetrahydrofuran or ethyl acetate, or a mixture thereof, or a mixed solvent of water and an organic solvent, and then coating by a conventional method.

The copolymer first peeling layer of the present invention may contain other materials such as a color toning agent, image stabilizer, antistatic agent, fluorescent brightener, matting agent, and antifogant so long as they have no adverse effect.

When the copolymer first peeling layer of the present invention is too thick, the rate of image formation (the rate of transfer) becomes low, the sharpness of the image is deteriorated, or fogging is liable to be caused in low temperature development, while when it is too thin, failure in the deposition of the processing solution is increased. The thickness of the layer is in the range of generally 0.001 to 1.0 g/m$^2$, preferably 0.01 to 0.5 g/m$^2$.

It is found that the surface of the copolymer first peeling layer of the present invention forms a nonpolar surface. Therefore, it is thought that good peeling properties from the cellulose ester layer are imparted by the nonpolar surface, irrespective of whether the time elapsed after the spreading of the processing solution is long or short, or the processing temperature is high or low. It is also found that the copolymer layer is substantially not diffused after peeling, but is left behind as a layer on the image receiving sheet. Therefore, it is thought that excellent scratch resistance is imparted thereby. Further, the copolymers of the present invention have a large proportion of a repeating unit having groups which are very hydrophobic and a monomer component whose homopolymer is soluble in water and/or an aqueous alkali, so that the copolymers have proper hydrophilicity. Accordingly, it is thought that there is no interference to the formation of the image, because materials for the formation of the image are allowed to freely permeate therethrough, these materials being entrained in or diffused in the processing solution, when the aqueous alkaline solution is spread during development.

Further, the copolymers for the copolymer first peeling layer of the present invention are synthetic copolymers so that they are excellent in long-term stability during manufacturing and storage.

The copolymer first peeling layer of the present invention can be coated by using organic solvents such as alcohols so that drying load during the formation of a film is low. This is an advantage of the present invention.

A layer containing a cellulose ester (a second peeling layer) of the peeling layers of the present invention is a layer containing a hydrolyzable, alkali-impermeable polymer, which is saponified by an alkali contained in the processing solution during development, whereby the layer is converted into a water-permeable layer.

Further, the second peeling layer is a layer which can be selectively peeled off from the first peeling layer.

When the second peeling layer of the present invention is too thick, the diffusion of the dye is retarded, while when the layer is too thin, the effect of isolating the dye and a long-term stable peeling effect cannot be obtained. The thickness of the second peeling layer is in the range of generally 0.02 to 0.9 $g/m^2$, preferably 0.05 to 0.6 $g/m^2$. Any hydrolyzable cellulose esters can be used. Examples of the cellulose esters include cellulose triacetate, cellulose diacetate, cellulose propionate and cellulose acetate butyrate.

The second peeling layer of the present invention may contain other binders provided that the effect of the present invention can be achieved.

In a preferred embodiment of the present invention, the peeling layers can be utilized as the peeling layers of the film unit for removing the used emulsion layer or a cover sheet.

In a more preferred embodiment, the diffusion transfer photographic film unit, wherein said support is white, further comprises a neutralizing layer between said support and said dye image receiving layer; a transparent cover sheet on the side of the silver halide emulsion layer opposite the support; means for providing an alkaline processing solution between said silver halide emulsion layer and said cover sheet; and at least one light shielding layer disposed on the side of the silver halide emulsion layer opposite said cover sheet.

Now, each element of the present invention other than the peeling layers is described in greater detail.

(A) Support

Any conventional supports can be used in the present invention, so long as they have dimensional stability and have no adverse effect on the photographic characteristics of the film unit. Examples of the supports include cellulose nitrate film, cellulose acetate film, cellulose acetate butyrate film, poly(vinyl acetal) film, polystyrene film, polyethylene terephthalate film, polycarbonate film, paper, metal and glass. Among them, cellulose acetate film, polyethylene terephthalate film and polyethylene-coated paper are preferred.

(B) Layer having a light shielding (screening) function

In the present invention, processing can be conducted in a light room or under daylight by completely shielding the sensitive layer from outdoor daylight during development by a layer having a light screening function on the side of the support opposite to the emulsion layer and the processing solution of a light shielding layer, the processing solution being spread over the sensitive element during processing. Specifically, a layer containing a light screening agent is provided on the back of the support or between the image receiving layer and the support. Alternatively, a layer containing a light screening agent may be incorporated in the support. Any material having a light shielding function can be used as the layer containing a light screening agent. Preferred materials are dispersions of black pigments such as dispersions of carbon black in an alkaline solution penetrable polymer matrix such as poly(vinyl alcohol), hydroxyethyl cellulose and gelatin.

The light shielding function of the present invention is such that the sensitive layer is shielded by light in a light room or under daylight. The light shielding of one side (surface) of the sensitive layer can be effected by spreading a processing composition having a light shielding function over the surface. The light shielding of the other side (surface) of the sensitive layer can be effected by providing a layer containing a light screening agent (a) between the support and a reflecting layer, (b) in the support itself and/or (c) on the back (the side opposite to the sensitive layer) of the support. The light shielding may be effected by afll of (a), (b), and (c), when the light shielding function of each is insufficient.

(C) Dye image receiving layer

The dye image receiving layer of the present invention contains a hydrophilic colloid containing a mordant. The layer may be composed of a single layer or a multi-layer structure where mordants having different mordanting power are multi-coated. The layer is described in more detail in JP-A-61-252551. As the mordant, polymer mordants are preferred.

The polymer mordants which can be used in the present invention include polymers having secondary and tertiary amino groups, polymers having a nitrogen-containing heterocylic ring moiety and polymers having a quaternary cationic group derived therefrom, the polymers having a molecular weight of not less than 5,000, preferably not less than 10,000.

Examples of the polymer mordants include vinylpyridine polymers and vinylpyridinium cationic polymers disclosed in U.S. Pat. Nos. 2,548,564, 2,484,430, 3,148,061 and 3,756,814; vinylimidazolium cationic polymers disclosed in U.S. Pat. No. 4,124,386; polymer mordants which are crosslinkable with gelatin disclosed in U.S. Pat. Nos. 3,625,694, 3,859,096 and 4,128,538 and U.K. Pat. No. 1,277,453; aqueous sol type mordants disclosed in U.S. Pat. No. 3,958,995, 2,721,852 and 2,798,063, JP-A-54-115228, JP-A-54-145529, JP-A-54-126027, JP-A-54-155835 and JP-A-56-17352; water-insoluble mordants disclosed in U.S. Pat. No. 3,898,088; reactive mordants capable of covalent bonding to dyes disclosed U.S. Pat. Nos. 4,168,976 and 4,201,840; and mordants disclosed in U.S. Pat. Nos. 3,709,690, 3,788,855, 3,642,482, 3,488,706, 3,557,066, 3,271,147 and 3,271,148, JP-A-53-30328, JP-A-52-155528, JP-A-53-125, JP-A-53-1024, JP-A-53-107835 and U.K. Pat. No. 2,064,802.

Further, mordants disclosed in U.S. Pat. Nos. 2,675,316 and 2,882,156 can be used.

(D) Layer having a neutralizing function

The layer having a neutralizing function according to the present invention is a layer containing an acidic substance in a sufficient amount to neutralize an alkali carried over from the processing solution. If desired, the layer may be composed of a multi-layer structure including a neutralization rate-adjusting layer (timing layer), and an adhesion-enhancing layer. Preferred acidic substances are those having an acid radical having a pKa of not higher than 9 (or those having a precursor group giving such an acid radical by hydrolysis). Preferred examples of the acidic substances include higher fatty acids such as oleic acid disclosed in U.S. Pat. No. 2,983,606; polymers of maleic acid, acrylic acid or methacrylic acid, partial esters thereof or acid anhydrides thereof disclosed in U.S. Pat. No. 3,362,819; copolymers of acrylic acid with acrylic esters disclosed in French Pat. No. 2,290,699; and latex type acid polymers disclosed in U.S. Pat. No. 4,139,383 and Research Disclosure No. 16102 (1977).

Further, there can be used acidic substances disclosed in U.S. Pat. No. 4,088,493, JP-A-52-153739, JP-A-53-1023, JP-A-53-4540, JP-A-53-4541 and JP-A-52-4542.

Examples of the acid polymers include copolymers of vinyl monomers such as vinyl acetate and vinyl methyl ether with maleic anhydride, copolymers of n-butyl ester or butyl acrylate with acrylic acid, and cellulose acetate hydrogen phthalate.

The acid polymers may be used as a mixture thereof with hydrophilic polymers. Examples of the hydrophilic polymers include polyacrylamide, polymethylpyrrolidone, poly(vinyl alcohol) (including partial saponified products), carboxymethylcellulose, hydroxymethylcellulose, hydroxyethylcellulose and poly(methylvinyl ether). Among them, poly(vinyl alcohol) is preferred.

The coating weight of the acid polymer is adjusted according to the amount of an alkali to be spread through the sensitive element. The preferred ratio per unit area of the acid polymer to the alkali is from 0.9 to 2.0 by equivalent. When the amount of the acid polymer is too small, the hue of the transfer dye is changed or stain is formed on colored area, while when the amount is too large, hue is changed or light resistance is lowered. A more preferred ratio is from 1.0 to 1.3 by equivalent. When the amount of the hydrophilic polymer is too large or too small, the quality of the photograph is lowered. The ratio of the hydrophilic polymer to the acid polymer is from 0.1 to 10, preferably 0.3 to 3.0 by weight.

Additives may be incorporated in the layer having a neutralizing function for various purposes. For example, a conventional hardening agent may be added to the layer for hardening the film. Polyhydroxy compounds such as polyethylene glycol, polypropylene glycol and glycerin may be added to the layer for improving the brittleness of the film. If desired, antioxidants, fluorescent brighteners, or bluing dyes may be added.

For the timing layer used in combination with the neutralizing layer, there can be used, for example, polymers which reduce alkali permeability, such as gelatin, poly(vinyl alcohol), partially acetalized pol(yvinyl alcohol), cellulose acetate and partially hydrolyzed poly(vinyl acetate); latex polymers which enhance activation energy for alkali permeation, prepared by copolymerizing a small amount of a hydrophilic monomer such as acrylic acid monomer; and polymers having a lactone ring.

Among them, there are particularly preferred timing layer obtained by using cellulose acetate disclosed in JP-A-54-136328, U.S. Pat. Nos. 4,267,262, 4,009,030 and 4,029,849; latex polymers prepared by copolymerizing a small amount of a hydrophilic comonomer such as acrylic acid disclosed in JP-A-54-128335, JP-A-56-69629, JP-A-57-6843, U.S. Pat. Nos. 4,056,394, 4,061,496, 4,199,362, 4,250,243, 4,256,827 and 4,268,604; polymers having a lactone ring disclosed in U.S. Pat. No. 4,229,516; and polymers disclosed in JP-A-56-25735, JP-A-56-97346, JP-A-57-6842 and European Published Patent Application Nos. 19597Al, 37724Al and 48412Al.

Further, there can be used materials disclosed in U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West-German Patent Application (OLS) Nos. 1622936 and 2162277 and Research Disclosure 15162 No. 151 (1976).

The timing layer prepared by using these material may be composed of a single layer, or two or more layers.

Development inhibitors and/or precursors thereof disclosed in U.S. Pat. No. 4,009,029, West German Patent Application (OLS) Nos. 2913164 and 3014672, JP-A-54-155837 and JP-A-55-138745, hydroquinone precursors and other photographically useful additives or precursors thereof disclosed in U.S. Pat. No. 4,201,578 may be optionally incorporated in the timing layers prepared from these materials.

When a hydrophobic compound is used in the timing layer which is used in combination with the neutralizing layer, the timing function can be improved, but adhesion to a hydrophilic layer (e.g., dye image receiving layer) to be provided thereon is lowered. Therefore, it is desirable that an adhesion enhancing layer is provided on the hydrophobic timing layer. Hydrophilic compounds or mixtures of the hydrophilic compounds and the hydrophobic compounds used for the timing layer can be used for the adhesion enhancing layer.

(E) Sensitive element

In the present invention, a sensitive element containing a silver halide emulsion layer in combination with a dye image forming substance is provided on the second peeling layer.

Now, the constituent elements thereof are described in greater detail.

(1) Dye image forming substance

The dye image forming substance which can be used in the present invention is a nondiffusible compound which releases a diffusing dye (or dye precursor) or a compound in which its diffusibility is changed in relation to silver development. Such compounds are described in T. H. James, *The Theory of the Photographic Process*, (4th ed. 977), p. 366–372. These compounds are represented by formula (III):

$$(DYE) - Y \qquad (III)$$

wherein DYE represents a dye or a precursor thereof, and Y represents a component which provides a compound having a diffusibility different from that of the parent compound under alkaline conditions. These compounds can be classified roughly into a negative type compound which is diffusible in the silver development area and a positive type compound which is diffusible in the undeveloped area by the function of the group Y.

Examples of the negative type Y are those which are oxidized by development and cleaved to thereby release a diffusible dye.

Specific examples of group Y are disclosed in U.S. Pat. Nos. 3,928,312, 3,993,638, 4,076,529, 4,152,153, 4,05,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP A-57-119345.

Among the group Y of negative type dye-releasing redox compounds, N-substituted sulfamoyl groups (examples of N-substituted groups including groups derived from aromatic hydrocarbon rings and heterocyclic rings) are particularly preferred. Typical examples of group Y include, but are not limited to, the following groups.

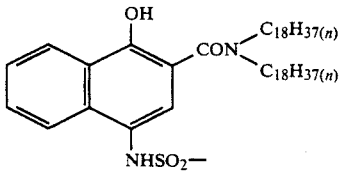

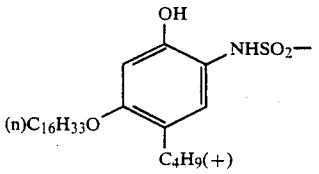

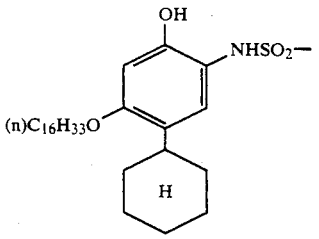

-continued

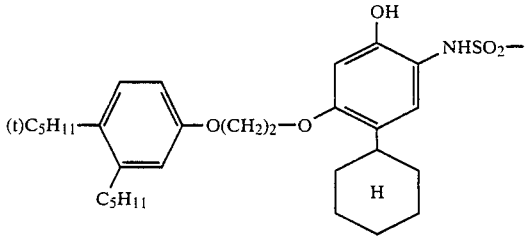

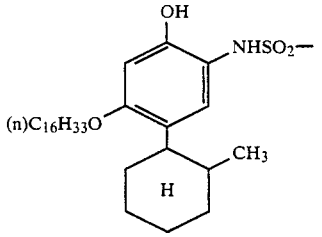

The positive type compounds are described in *Angew. Chem. Int. Ed. Engl.*, 22,191 (1982).

Examples of the compounds include compounds (dye developing agents) which are first diffusible under alkaline conditions, but are made non-diffusing by oxidation during development. Typical examples of the group Y of these compounds are disclosed in U.S. Pat. No. 2,983,606.

Other examples thereof include compounds which release a diffusible dye, for example, by self-cyclization, under alkaline conditions, but, when oxidized by development, do not release substantially any dye. Examples of the group Y having this function are described in U.S. Pat. Nos. 3,980,479, 3,421,964 and 4,199,355, JP-A-53-69033 and JP-A-54-130927.

Still other examples thereof include compounds which themselve do not release any dye, but, when reduced, release a dye. These compounds can be used in combination with electron donors to thereby allow a diffusible dye to be released imagewise by the reaction with the remaining electron donor oxidized imagewise by silver development. Examples of atomic groups having such a function are disclosed in, for example, U.S. Pat. Nos. 4,183,753, 4,142,891, 4,278,750, 4,139,379, 4,218,368, 4,356,249 and 4,358,525, JP-A-53-110827, JP-A-54-130927, JP-A-56-164342, Kokai Giho (Published Technical Report, Japan) 87-6199 and European Published Patent Application No. 2207456A2.

Specific examples of groups include, but are not limited to, the following groups.

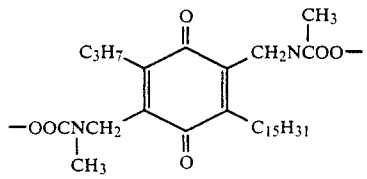

-continued

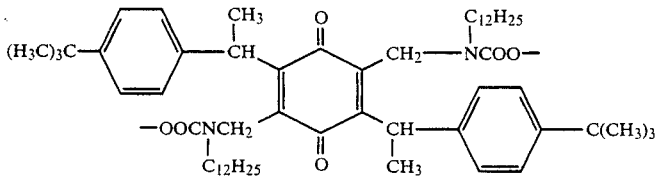

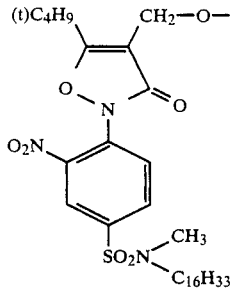

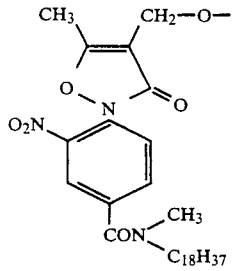

When compounds of this type are used, it is preferred that the compounds are used in combination with non-diffusible electron donating compounds (known as ED compounds) or their precursors. Examples of the ED compounds are described in U.S. Pat. Nos. 4,263,393 and 4,278,750 and JP-A-56-138736.

Other examples of the dye image forming substances include the following compounds.

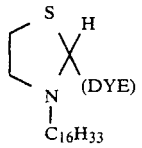

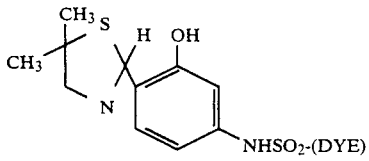

In the formulas, Dye is the same dye or precursor as that set forth above.

The dye image forming substances of this type are described in more detail in U.S. Pat. Nos. 3,719,489 and 4,098,783.

Specific examples of the dyes represented by DYE in the formulas are described in the following publications.

Examples of yellow dyes are described in U.S. Pat. Nos. 3,597,200, 3,309,199, 4,013,633, 4,245,028, 4,156,609, 4,139,383, 4,195,992, 4,148,641, 4,148,643k and 4,336,322, JP-A-51-114930, JP-A-56-71072 and *Research Disclosure* 17630 (1978) and *ibid.* 16475 (1977).

Examples of magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of cyan dyes are described in U.S. Pat. Nos. 3,482,972, 3,929,760, 4,013,635, 4,268,625, 4,171,220, 4,242,435, 4,142,891, 4,195,994, 4,147,544 and 4,148,682, U.K. Pat. No. 1,551,138, JP-A-54-99431, JP-A-52-8827, JP-A-53-47823, JP-A-53-143323, JP-A-54-99431, JP-A-56-71061, European Published Patent Application Nos. 53037 and 53040 and *Research Disclosure* 17630 (1978) and *ibid.* 16475 (1977).

(2) Silver halide emulsion

Any of a negative type emulsion in which a latent image is predominantly formed on the surface of silver halide grain and internal latent image type direct positive emulsion in which a latent image is formed in the interior of silver halide grains, can be used as the silver halide emulsion of the present invention.

Examples of the internal latent image type direct positive emulsion include a conversion type emulsion prepared by utilizing a difference in solubility between silver halides; and a core/shell type emulsion prepared by coating at least sensitive site of the inner core grains of silver halide which is doped with a metal ion and/or chemically sensitized, with an outer shell of silver halide. The internal latent image type direct positive emulsion is described in more detail in U.S. Pat. Nos. 2,592,250, 3,206,313, 3,761,276, 3,935,014, 3,447,927, 2,497,875, 2,563,785, 3,551,662, 4,395,478 and 4,431,730, West German Pat. No. 2728108 and U.K. Pat. No. 1,027,146.

When the internal latent image type direct positive emulsion is used, it is necessary that a fog nucleus is formed on the surface by using light or a nucleating agent after imagewise exposure.

Examples of the nucleating agent include hydrazines disclosed in U.S. Pat. No. 2,563,785 and 2,588,982; hydrazides and hydrozones disclosed in U.S. Pat. No. 3,227,552; heterocyclic quaternary salt compounds disclosed in U.K. Pat. No. 1,283,835, JP-A-52-69613, U.S. Pat. Nos. 3,615,615, 3,719,494, 3,734,738, 4,094,683 and 4,115,122; sensitizing dyes having a substituent group having a nucleating function in the dye molecule disclosed in U.S. Pat. No. 3,718,470; thiourea-bonded type acylhydrazine compounds disclosed in U.S. Pat. Nos. 4,030,925, 4,031,127, 4,245,037, 4,255,511, 4,266,013 and 4,276,364 and U.K. Pat. No. 2,012,443; and acylhydrazine compounds having a thioamide ring or a heterocyclic ring such as triazole or tetrazole as an adsorbing group disclosed in U.S. Pat. Nos. 4,080,270 and 4,278,748 and U.K. Pat. No. 2,011,391B.

In the present invention, spectral sensitizing dyes are used in combination with the negative type emulsion and the internal latent image type direct positive emulsion. Specific examples of the spectral sensitizing dyes are disclosed in JP-A-59-180550, JP-A-60-140335, Research Disclosure No. 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349.

(3) Constitution of sensitive element

For the reproduction of natural color by the subtractive color process, there is used a sensitive (photosensitive) layer containing at least two emulsions optically sensitized by said spectral sensitizing dyes with the above-described dye image forming substances, which donate dyes having spectral absorption selectively in the same wavelength range as that of the emulsions. The emulsion and the dye image forming substance may be coated in separate layers, or may be mixed and coated as one layer. It is preferred that they are coated as separate layers when the dye image forming substance in the coated state exhibits absorption in the spectral sensitivity region of the emulsion combined therewith. The emulsion layer may be composed of a plurality of emulsion layers having different sensitivities. Any layers may be optionally provided between the emulsion layer and the dye image forming substance layer. For example, a layer containing a nucleating development accelerator disclosed in JP-A-60-173541 and a barrier layer disclosed in JP-A-60-15267 may be provided therebetween to increase the density of a color image. A reflecting layer disclosed in JP-A-60-91354 may be provided therebetween to enhance the sensitivity of the sensitive element.

In a preferred multi-layer structure, a unit of a combination of blue-sensitive emulsion, a unit of a combination of green-sensitive emulsion and a unit of a combination of red-sensitive emulsion are disposed in that order from the exposure side.

Optionally, any layer may be provided between the emulsion layer units. It is particularly preferred to provide an intermediate layer to prevent other emulsion layer units from being adversely affected by the development of an emulsion layer.

It is preferred that the intermediate layer contains a nondiffusible reducing agent to prevent an oxidation product of a developing agent from diffusing, when the developing agent is used in combination with a nondiffusible dye image forming substance. Specific examples of the nondiffusible reducing agent include non-diffusible hydroquinone, sulfonamidophenols and sulfonamidonaphthols. Specific examples thereof are disclosed in JP-B-50-21249, JP-B-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393 and 3,700,453, U.K. Pat. No. 557,750, JP-A-57-24941 and JP-A-58-21249. Methods for dispersing them are disclosed in JP-A-60-238831 and JP-B-60-18978.

It is preferred that the intermediate layer contains a compound capable of supplementing silver ion, when a compound releasing a diffusing dye by silver ion is used (as described in JP-B-55-7576).

If desired, an irradiation inhibiting layer, barrier layer, and protective layer, may be coated.

(F) Processing Composition

The processing composition used in the present invention is uniformly spread over the sensitive element after the exposure of the sensitive layer, cooperating with the light shielding layer provided on the back of the support or on the opposite side to the processing solution of the sensitive layer to completely shield the sensitive layer from external light and at the same time to develop the sensitive layer with components contained therein. Accordingly, the composition contains alkali, thickener, light screening agent, developing agent, development accelerator (which controls development), and antioxidant (which prevents the development accelerator and the developing agent from being deteriorated). The composition must contain the light screening agent.

The alkali is used to adjust the pH of the solution to from 12 to 14. Examples of the alkali include alkali metal hydroxides (e.g., sodium hydroxide, potassium hydroxide, lithium hydroxide), alkali metal phosphates (e.g., potassium phosphate), guanidines and quaternary ammonium hydroxides (e.g., tetramethylammonium hydroxide). Among them, sodium hydroxide and potassium hydroxide are preferred.

The thickener is used for the purposes of uniformly spreading the processing solution or keeping adhesion between the sensitive layer and the cover sheet in peeling the used sensitive layer together with the cover sheet. Examples of the thickener include polyvinyl alcohol, hydroxyethyl cellulose and alkali metal salts of carboxymethyl cellulose. Among them, hydroxyethyl cellulose and sodium carboxymethyl cellulose are preferred.

Polymers having an oxime group disclosed in U.S. Pat. No. 4,397,996 can also be used.

As the screening agent, any of dyes, pigments and combinations thereof can be used, so long as they are not diffused into the dye image receiving layer and nor form any stain. A typical example thereof is carbon black. Combinations of titanium white with dyes can be used. As the dyes, there may be used temporarlily light shielding dyes which become colorless after a given period of time during processing.

Any developing agents can be used, so long as they cross-oxidize the dye image forming substances and do not form substantial stain even when oxidized. These developing agents may be used either alone or as a mixture of two or more of them. The agents may be used in the form of precursors. These developing agents may be incorporated in a proper layer of the sensitive layer or may be contained in the alkaline processing solution. Specific examples of the developing agents include aminophenols and pyrazolidinones, among which pyrazolidinones are preferred, because stain is scarcely formed. Examples of the pyrazolidinones include 1-phenyl-3-pyrazolidinone, 1-p-tolyl-4,4-dihydroxymethyl-3-pyrazolidinone, 1-(3'-methyl-phenyl)-4-methyl-4-hydroxy-methyl-3-pyrazolidinone, 1-phenyl-4-methyl-4-hydroxy-methyl-3-pyrazolidinone and 1-p-tolyl-4-methyl-4-hydroxy-methyl-3-pyrazolidinone.

(G) Cover sheet

In the present invention, there is used a transparent cover sheet to allow the processing solution to be uniformly spread over the sensitive element. The cover sheet is peeled off together with the processing solution and the used sensitive layer after processing. Accordingly, it is preferred that the surface of the cover sheet is treated or an appropriate adhesive layer is provided on the surface thereof, to impart sufficient adhesion to the processing solution.

As the adhesive layer, a hydrophilic layer described in JP-B-61-49658 is preferred. A filter dye may be incorporated in the cover sheet to control the sensitivity of the sensitive layer. The filter dye may be added directly to the support of the cover sheet, or may be coated as a separate layer.

Any of smooth, transparent supports used conventionally for photographic materials can be used as the support of the cover sheet of the present invention. Examples of materials for the supports include cellulose acetate, polystyrene, polyethylene terephthalate and polycarbonates. An undercoat layer may be provided. Undercoating solutions conventionally used for photographic materials can be used to form the undercoat layer.

The cover sheet may be provided with the abovedescribed layer having a neutralizing function.

The film unit of the present invention is processed into a monosheet by using masking material, rail material, and surplus solution trap, as described in JP-B-48-33697, JP A-48-43317, JP-A-50-153628, JP-A-52-11027 and JP-A-57-48629.

The provision of slits is effective to facilitate peeling after processing as described in *Research Disclosure*, No. 23026 (1983). The shape and depth of the slit can be chosen according to the physical properties of the white support.

The size of the film unit can be properly adjusted to the size of commercially available instant film, the size of more compact film or the sizes of larger films.

The reflected image of an object must be formed on the film to take a photograph thereof by using the film unit of the present invention. For this purpose, mirrors must be used.

Cameras therefor are described in U.S. Pat. No. 3,447,437.

The present invention is now illustrated in greater detail by reference to the following examples which, however, are not to be construed as limiting the present invention. Unless otherwise indicated, all parts, percents and ratios are by weight.

Example 1

A carbon black layer (containing 3.0 g of carbon black per $m^2$ and 4.5 g of gelatin per $m^2$) and a titanium oxide layer (containing 3.0 g of titanium oxide per $m^2$ and 1.0 g of gelatin per $m^2$) in that order were coated on one surface of a polyethylene terephthalate support containing a titanium oxide white pigment to form a light shielding layer.

On the opposite side to the light shielding layer of the support, there were then coated the following layers in that order to prepare an image receiving photosensitive sheet.

(1) A neutralizing layer containing 6 g/$m^2$ of cellulose acetate (degree of acetylation: 55% per $m^2$), 4 g/$m^2$ of a methyl vinyl ether-maleic anhydride copolymer, 0.05 g/$m^2$ of titanium dioxide and 0.82 g/$m^2$ of the following compound.

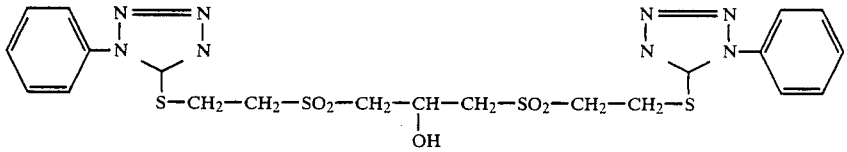

(2) A layer containing 1.3 g/$m^2$ as solid of a styrene-n-butyl acrylate acrylic acid-methylolacrylamide (49.7/42.3/4/4) copolymer latex and 1.3 g/$m^2$ as solid of a methyl methacrylate-acrylic acid-methylolacrylamide (93/3/4) copolymer latex.

(3) A layer containing 0.5 g/$m^2$ as solid of a styrene-n-butyl acrylate-acrylic acid-methylolacrylamide (49.7/42.3/4/4) copolymer latex and 0.5 g/$m^2$ of gelatin.

(4) A reflecting layer containing 5 g/$m^2$ of titanium oxide and 0.5 g/$m^2$ of gelatin.

(5) An image receiving image layer containing 3 g/$m^2$ of the following polymer latex mordant and 3 g/$m^2$ of gelatin.

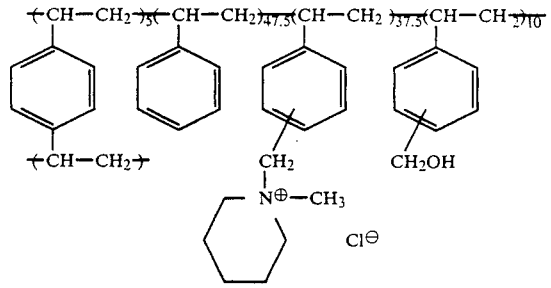

(6) A first peeling layer comprising 0.04 g/$m^2$ of the copolymer 2 (lauryl methacrylate-acrylic acid (50/50 by weight) copolymer) of the present invention.

(7) A second peeling layer comprising 0.1 g/$m^2$ of diacetyl cellulose.

(8) A layer containing 1 g/$m^2$ of ethyl acrylate latex and 2.5 g/$m^2$ of gelatin.

(9) A layer containing 44 g/$m^2$ of the following cyan dye-releasing redox compound, 0.09 g/$m^2$ of tricyclohexyl phosphate, 0.008 g/$m^2$ of 2,5-di-t-pentadecylhydroquinone, 0.05 g/$m^2$ of carbon black and 0.8 g/$m^2$ of gelatin.

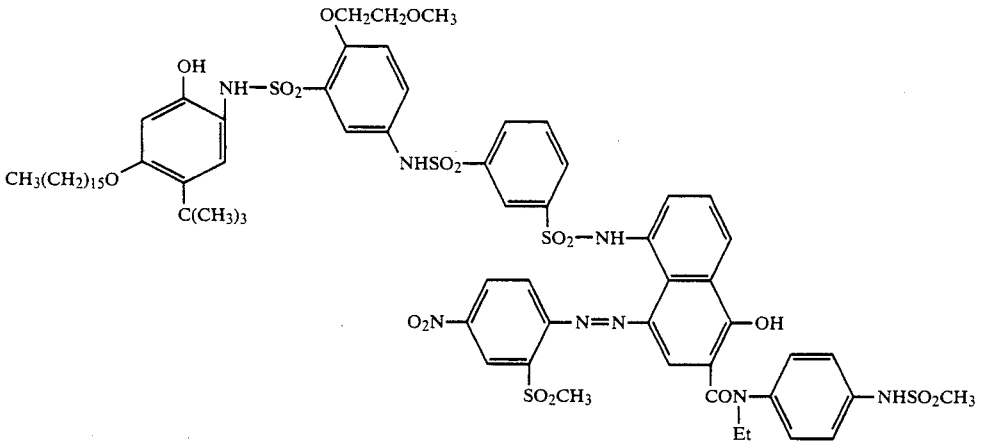

(10) A light reflecting layer containing 2 g/m$^2$ of titanium oxide and 0.5 g/m$^2$ of gelatin.

(11) A low-sensitivity red-sensitive emulsion layer containing an octahedral internal latent image type direct positive silver bromide emulsion having a grain size of 1.0 μm (0.15 g/m$^2$ as silver), a red-sensitive sensitizing dye, 0.4 g/m$^2$ of gelatin, 1.1 μg/m$^2$ of the following nucleating agent (NA) and 0.02 g/m$^2$ of the sodium salt of 2-sulfo-5-n-pentadecylhydroquinone.

(NA)

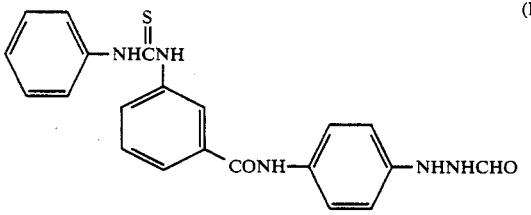

(12) A high-sensitivity red-sensitive emulsion layer containing an octahedral internal latent image type direct positive silver bromide emulsion having a grain size of 1.6 μm (0.5 g/m$^2$ as silver), a red-sensitive sensitizing dye, 0.8 g/m$^2$ of gelatin, 3.0 μg/m$^2$ of the same nucleating agent (NA) as in layer (11) and 0.04 g/m$^2$ of sodium salt of 2-sulfo-5-n-pentadecylhydroquinone.

(13) A color mixing inhibiting layer containing 1.2 g/m$^2$ of 2,5-di-t-pentadecylhydroquinone, 1.2 g/m$^2$ of polymethyl methacrylate and 0.7 g/m$^2$ of gelatin.

(14) A layer containing 0.3 g/m$^2$ of gelatin.

(15) A layer containing 0.15 g/m$^2$ of the following magenta dye-releasing redox compound, 0.1 g/m$^2$ of tricyclohexyl phosphate, 0.009 g/m$^2$ of 2,5-di-t-pentadecylhydroquinone and 0.9 g/m2 of gelatin.

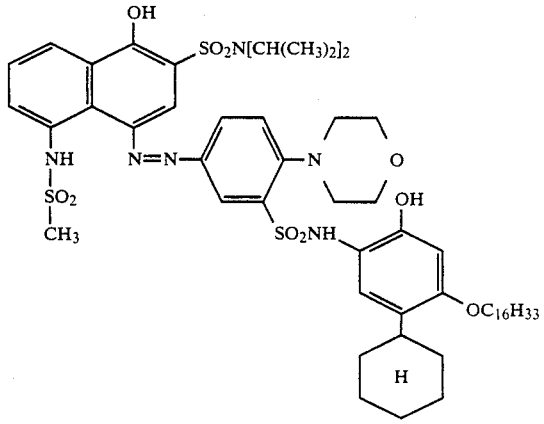

(16) A light reflecting layer containing 1 g/m$^2$ of titanium oxide and 0.25 g/m$^2$ of gelatin.

(17) A low-sensitivity green-sensitive emulsion layer containing an octahedral internal latent image type direct positive silver halide emulsion having a grain size of 1.0 μm (0.12 g/m$^2$ as silver), a green-sensitive sensitizing dye, 0.25 g/m$^2$ of gelatin, 1.1 μg/m$^2$ of the same nucleating agent (NA) as in layer (11) and 0.02 g/m$^2$ of 2-sulfo-5-n-pentadecylhydroquinone sodium salt.

(18) A high-sensitivity green-sensitive emulsion layer containing an octahedral internal latent image type direct positive silver bromide emulsion having a grain size of 1.6 μm (0.35 g/m$^2$ as silver), a green-sensitive sensitizing dye, 0.7 g/m$^2$ of gelatin, 1.7 μg/m$^2$ of the same nucleating agent (NA) as in layer (11) and 0.04 g/m$^2$ of 2-sulfo-5-n-pentadecylhydroquinone sodium salt.

(19) A color mixting inhibiting layer containing 0.8 g/m$^2$ of 2,5-di-t-pentadecylhydroquinone, 0.8 g/m$^2$ of polymethyl methacrylate and 0.45 g/m$^2$ of gelatin.

(20) A layer containing 0.3 g/m$^2$ of gelatin.

(21) A layer containing the following yellow dye releasing redox compound (0.53 g/m$^2$), tricyclohexyl phosphate (0.13 g/m$^2$), 2,5-di-t-pentadecylhydroquinone (0.014 g/m$^2$) and gelatin (0.7 g/m$^2$).

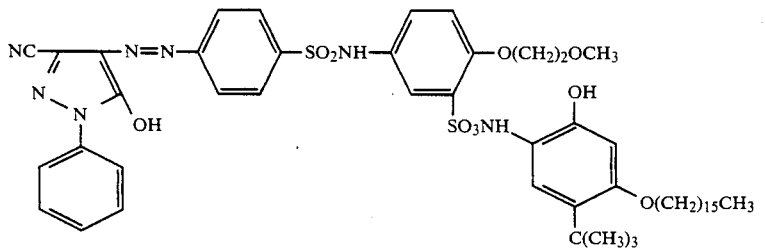

(22) A light reflecting layer containing 0.7 g/m$^2$ of titanium oxide and 0.18 g/m$^2$ of gelatin.

(23) A low-sensitivity blue sensitive emulsion layer containing an octahedral internal latent image type direct positive silver bromide emulsion having a grain size of 1.1 μm (0.25 g/m$^2$ as silver), a blue-sensitive sensitizing dye, 0.4 g/m$^2$ of gelatin, 2 μg/m$^2$ of the same nucleating agent (NA) as in layer (11) and 0.045 g/m$^2$ of 2-sulfo-5-n-pentadecylhydroquinone sodium salt.

(24) A high-sensitivity blue-sensitive emulsion layer containing an octahedral internal latent image type direct positive silver halide emulsion having a grain size of 1.7 μm (0.42 g/m$^2$ as silver), a blue-sensitive sensitizing dye, 0.45 g/m$^2$ of gelatin, 3.3 μg/m$^2$ of the same nucleating agent (NA) as in layer (11) and 0.025 g/m$^2$ of sodium salt of 2-sulfo-5-n-decylhydroquinone.

(25) An ultraviolet light absorbing layer containing $4\times10^{-4}$ mol/m$^2$ of each of the following ultraviolet absorbers and 0.5 g/m$^2$ of gelatin.

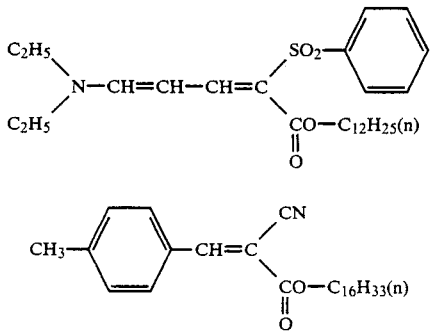

(26) A protective layer containing a matting agent and 0.5 g/m$^2$ of gelatin.

The following layers in the following order were coated on the surface of a polyethylene terephthalate support having a gelatin undercoat layer and containing a light-piping inhibiting dye to prepare a cover sheet.

(1) A neutralizing layer containing 6 g/m$^2$ of cellulose acetate (degree of acetylation 55.5%) and 4 g/m$^2$ of a methyl vinyl ether-maleic anhydride copolymer.

(2) A layer containing 3.9 g/m$^2$ (as solid) in total of a blend obtained by blending a polymer latex (prepared by emulsion-polymerization of styrene, n-butyl acrylate, acrylic acid and N-methylolacrylamide in a ratio of 49.7/42.3/4/4 by weight) with a polymer latex (prepared by emulsion-polymerization of methyl methacyrlate, acrylic acid and N-methylolacrylamide in a ratio of 93/3/4 by weight)in a ratio of 5 : 5 on a solid basis.

(3) A layer containing 0.5 g/m$^2$ of a polymer latex (prepared by emulsion-polymerization of styrene, n-butyl acrylate, acrylic acid and N-methylolacrylamide in a ratio 49.7/42.3/4/4 by weight) and 0.5 g/m$^2$ of gelatin.

The image receiving photosensitive sheet and the cover sheet were superposed in surface-to-surface contact. The following alkaline processing solution containing a light screening agent and having the following composition was put into a bag which could be ruptured by pressure. The photosensitive sheet, the cover sheet and the bag were integrally fixed to prepare a photographic film unit (1-1) according to the present invention.

| Processing solution | |
|---|---|
| 1-m-Tolyl-4-hydroxymethyl-4-methyl-3-pyrazolidinone | 10 g |
| 1-Phenyl-4-hydroxymethyl-4-methyl-3-pyrazolidinone | 4 g |
| 5-Methylbenzotriazole | 1.2 g |
| Benzotriazole | 6 g |
| Potassium sulfite | 8 g |
| Carboxymethyl cellulose | 45 g |
| Potassium hydroxide | 64 g |
| 1,4-Cyclohexanedimethanol | 4.5 g |
| Carbon black | 150 g |
| Water to make | 1 kg |

Photosensitive image receiving sheets (1-2) and (1-3) were prepared in the same manner as for photosensitive image receiving sheet ( 1-1) except that each of the following first peeling layers (6′) and (6″) was provided in place of the first peeling layer (6).

(6′) A first peeling layer consisting of 0.04 g/m$^2$ of a butyl methacrylate-acrylic acid (50:50 by weight) copolymer.

(6″) A first peeling layer containing 0.04 g/m$^2$ of the copolymer 22 of the present invention.

Photosensitive image receiving sheets (1-4) and (1-5) were prepared in the same manner as for photosensitive image receiving sheet (1-1) was repeated except that each of the following second peeling layers (7′) and (7″) was provided in place of the second peeling layer (7).

(7′) A second layer containing 0.1 g/m$^2$ of hydroxyethyl cellulose.

(7″) A second peeling layer containing 0.1 g/m$^2$ of triacetyl cellulose.

Photosensitive image receiving sheet (1-6) were prepared in the same manner for photosensitive image receiving sheet (1-1) was repeated, except that the following first peeling layer (6″) was provided in place of the first peeling layer (6) and the second peeling layer (7) was omitted.

(6‴) A first peeling layer containing 0.5 g/m$^2$ of the copolymer 2 used for the first peeling layer of the sheet (1-1).

The film unit was exposed through the cover sheet to color test chart. The film unit was then passed through a pair of rollers, whereby the processing solution in a processing pod was uniformly spread between the sensitive element and the cover sheet. After the processing solution was spread and a given time was elapsed, the cover sheet was peeled off.

The evaluation of wet peelability was made under such conditions that the time required for peeling off was 5 minutes. The evaluation was made by determining the ratio of the area of a desired image obtained by clear peeling between the peeling layers. When complete peeling was made, the ratio was 100%. The measurement of the minimum image density Dmin was made when the time required for peeling off was 10 minutes. The minimum white image density Dmin of a transferred image after peeling was measured through a red filter. A smaller value is superior. Scratch resistance was evaluated when the time required for peeling off was 5 minutes. Scratch resistance after 5 seconds from peeling off was evaluated. A scratch resistance test was made using a 1 mm diameter sapphire needle. The load applied to the needle when the surface of the image was broken and a scar was left, was defined as scratch resistance. The layer the value, the greater the scratch resistance. The results of the measured values for each film unit are shown in Table 1.

TABLE 1

| Sample No. | Dmin | Wet peelability | Scratch resistance | Remarks |
|---|---|---|---|---|
| I-1 | 0.18 | 100% | 105 g | Invention |
| I-2 | 0.50 | 100% | 70 g | Comparison |
| I-3 | 0.19 | 100% | 100 g | Invention |
| I-4 | 0.59 | 80% | 80 g | Comparison |
| I-5 | 0.16 | 100% | 105 g | Invention |
| I-6 | 0.60 | 100% | 30 g | Comparison |

It is apparent from Table 1 that each desired property was not satisfied by the Comparative Samples, though individual performance was good. Namely, samples (1-2) and (1-4) had high Dmin and were inferior in scratch resistance and, the sample (1-6) had very poor scratch resistance, while the samples (1-1), (1-3) and (1-5) of the present invention were excellent in Dmin, wet peelability and scratch resistance.

EXAMPLE 2

A carbon black layer (containing 3.0 g/m$^2$ of carbon black and 4.5 g/m$^2$ of gelatin) and a titanium white layer (containing 3.0 g/m$^2$ of titanium white and 1.0 g/m2 of gelatin) in that order were coated as the light shielding layer on one surface of a polyethylene-coated paper support.

On the opposite side to the light shielding layer of the support, there were then coated the following layers in order to prepare an image receiving photosensitive sheet.

(1) A neutralizing layer containing 30 g/m$^2$ of butyl half ester (average molecular weight: about 100,000) of a maleic anhydride-methyl vinyl ether (1 : 1) copolymer, 0.05 g/m$^2$ of .titanium dioxide and 0.8 g/m$^2$ of the following compound.

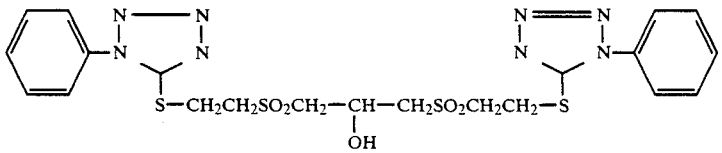

(2) A timing layer containing 0.49 g/m$^2$ of a butyl acrylate-diacetone acrylamide-styrene-methacyrlic acid (60/30/4/6) copolymer and 0.01 g/m$^2$ of polyacrylamide.

(3) A reflecting layer containing 10 g/m$^2$ of titanium dioxide and 1 g/m$^2$ of gelatin.

(4) An image receiving layer containing 3.2 g/m$^2$ of poly-4-vinylpyridine (average molecular weight: 80,000) and 3.2 g/m$^2$ of polyvinyl alcohol (degree of saponification: 98%, average molecular weight: about 80,000).

(5) A first peeling layer containing 0.04 g/m$^2$ of the copolymer 1 (lauryl methacrylate-acrylic acid (8/20) copolymer) of the present invention.

(6) A second peeling layer comprising 0.7 g/m$^2$ of cellulose acetate (degree of acetylation: 51%).

(7) A layer containing 1 g/m$^2$ of ethyl acrylate latex and 2.5 g/m$^2$ of gelatin.

(8) A red-sensitive emulsion layer containing a negative silver iodobromide emulsion (2.3 g/m$^2$ as silver, iodine content: 2 mol%), 1.7 g/m$^2$ of gelatin and a red-sensitive sensitizing dye, 3,3',9-triethyl-5,5'-dichlorothiacarbocyanine iodide.

(9) A layer containing 0.8 g/m$^2$ of the following cyan dye developeer temporarily shifted to shorter wavelengths, 0.8 g/m$^2$ of N,N-diethyllaurylamide and 1.1 g/m$^2$ of gelatin.

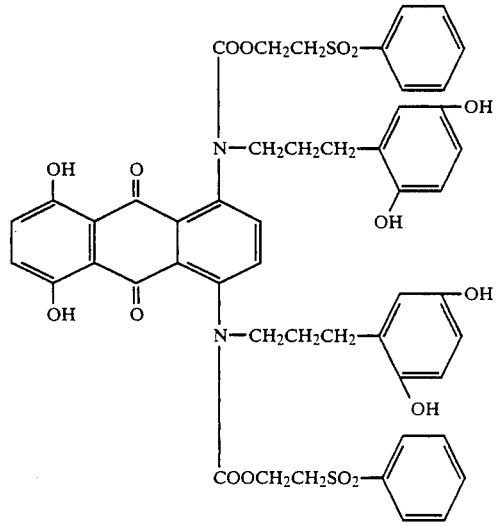

(10) A layer containing 3.5 g/m$^2$ of gelatin.

(11) A green-sensitive emulsion layer containing a negative silver iodobromide emulsion (1.7 g/m$^2$ as silver, iodine content: 2 mol%), 1.3 g of m$^2$ of gelatin and a green-sensitive sensitizing dye 3,3'9- triethyl-5,5'-diphenyloxacarbocyanin bromide.

(12) A layer containing 0.6 g/m$^2$ of the following magenta dye-developer temporarily shifted to shorter wavelengths, 0.6 g/m$^2$ of N,N-diethyllaurylamide and 1.2 g/m$^2$ of gelatin.

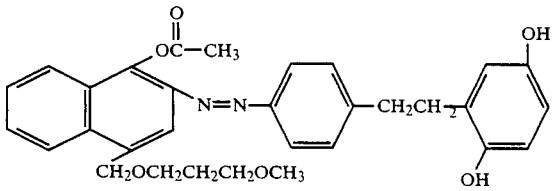

(13) A layer containing 3.0 g/m$^2$ of gelatin.

(14) A blue-sensitive emulsion layer containing a negative silver iodobromide emulsion (1.8 g/m$^2$ as silver, iodine content: 2 mol%) and 1.6 g/m$^2$ of gelatin.

(15) A layer containing 10 g/m2 of the following yellow dye-developer temporarily shifted to shorter wavelengths, 1.0 g/m$^2$ of N,N-diethyllaurylamide and 1.8 g/m$^2$ of gelatin.

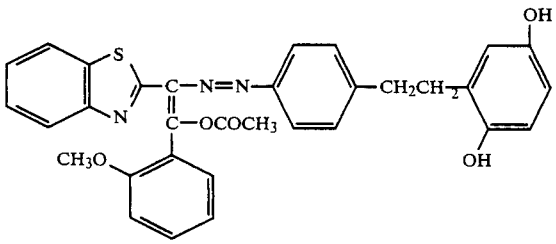

(16) A layer containing 0.45 g/m$^2$ of 4'-methylphenylhydroquinone, 0.45 g/m$^2$ of tri-o-cresylphosphate and 1.3 g/m$^2$ of gelatin (further containing 0.02 g/m$^2$ of mucochloric acid as a hardening agent).

The image receiving photosensitive sheet and the cover sheet of Example 1 were superposed in surface-to-surface contact. The following alkaline processing solution containing a light screening agent and having the following composition was put into a pressure-rupturable bag. The photosensitive sheet, the cover sheet and the bag were integrally fixed to prepare a film unit of the present invention.

| Processing solution | |
|---|---|
| N-Benzyl-α-picolinium bromide | 20 g |
| Benzotriazole | 15 g |
| Carboxymethyl cellulose | 35 g |
| Potassium hydroxide | 95 g |
| Carbon black | 150 g |
| Water to make | 1 kg |

The above photographic film unit was exposed from the cover sheet side by a gray wedge. The processing solution was then spread at 25° C. in a thickness of 100 μm by using a pressing member to carry out development. After three minutes from the spreading of the processing solution, peeling was conducted. Wet peelability between the peeling layers of the image receiving photosensitive sheet was 100%. There was obtained an excellent image having a minimum image density Dmin of as low as 0.16 and scratch resistance of 140 g.

The present invention provides a color diffusion transfer photograph which is excellent in peeling properties, has a low minimum image density and is excellent in resistance to scratching on the surface of image, and the peeling type film unit of the present invention can be processed in room light.

While the invention has been described in detail and with reference to specific embodiments thereof, it will be apparent to one skilled in the art that various changes and modifications can be made therein without departing from the spirit and scope thereof.

What is claimed is:

1. A diffusion transfer photographic film unit comprising a support having thereon outwardly from said support (a) a dye image receiving layer; (b) a first peeling layer containing a copolymer of at least (i) an ethylenically unsaturated monomer containing at least one hydrocarbon group containing from 7 to 18 carbon atoms, and (ii) an ethylenically unsaturated monomer, the homopolymer of which is soluble in water or an aqueous alkaline solution; (c) a second peeling layer containing a cellulose ester; and (d) a light-sensitive silver halide emulsion layer containing a light-sensitive silver halide and a dye image forming substance.

2. The diffusion transfer photographic film unit as claimed in claim 1, wherein said support is white and said film unit further comprises a neutralizing layer between said support and said dye image receiving layer; a transparent cover sheet on the side of the silver halide emulsion layer opposite the support; means for providing an alkaline processing solution between said silver halide emulsion layer and said cover sheet; and at least one light shielding layer disposed on the side of the silver halide emulsion layer opposite said cover sheet.

3. The diffusion transfer photographic film unit as claimed in claim 2, wherein said ethylenically unsaturated monomer containing at least one hydrocarbon group containing from 7 to 18 carbon atoms is represented by formula (I)

$$CH_2{=}CR_1R_2 \qquad (I)$$

Wherein $R_1$ represents a hydrogen, a halogen atom, a cyano group or a substituted or unsubstituted alkyl group having from 1 to 4 carbon atoms; and $R_2$ represents a monovalent group containing at least one hydrocarbon group $R_3$ containing from 7 to 18 carbon atoms.

4. The diffusion transfer photographic film unit as claimed in claim 3, wherein $R_1$ represents hydrogen or methyl and $R_3$ represents an alkyl group, an alkylene group, an aralkyl group, an aralkylene group, an aryl group, or an arylene group.

5. The diffusion transfer photographic film unit as claimed in claim 4, wherein $R_3$ represents an alkyl group, an alkylene group or an aryl group.

6. The diffusion transfer photographic film unit as claimed in claim 3, wherein $R_2$ represents —$COOR_3$, —$CONHR_3$,

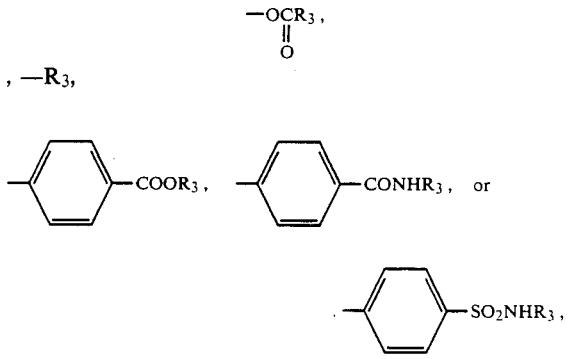

in which $R_3$ represents a hydrocarbon group containing from 7 to 18 carbon atoms.

7. The diffusion transfer photographic film unit as claimed in claim 5, wherein $R_3$ represents an alkyl group containing from 8 to 12 carbon atoms.

8. The diffusion transfer photographic film unit as claimed in claim 3, wherein said monomer represented by formula (I) is selected from an acrylic ester, a methacrylic ester, a substituted acrylamide, a substituted methacrylamide, a vinyl ester, and a substituted styrene.

9. The diffusion transfer photographic film unit as claimed in claim 8, wherein said monomer represented by formula (I) is selected from an alkyl acrylate and an alkyl methacrylate, in which the alkyl moiety has from 8 to 18 carbon atoms.

10. The diffusion transfer photographic film unit as claimed in claim 1, wherein said ethylenically unsaturated monomer, the homopolymer of which is soluble in water or an aqueous alkaline solution, is represented by formula (II):

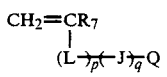

(II)

wherein $R_7$ represents hydrogen, an alkyl group or a halogen atom; L represents —CONH—, —NHCO—, —COO—, —OCO—, —CO—, —$SO_2$—, —$NHSO_2$—, —$SO_2NH$ or —O—; J represents a substituted or unsubstituted alkylene group, a substituted or unsubstituted arylene group, a substituted or unsubstituted aralkylene group; Q represents

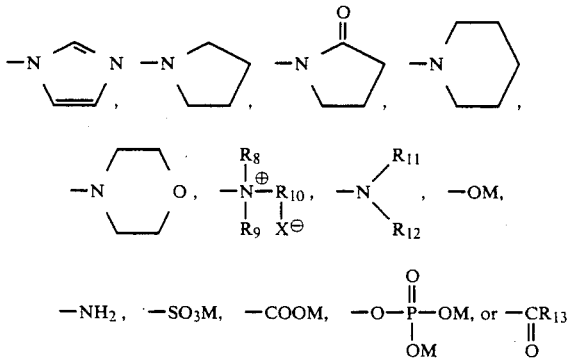

wherein M represents hydrogen or a cation; $R_{13}$ represents an alkyl group having from 1 to 4 carbon atoms; $R_8$, $R_9$, $R_{10}$, $R_{11}$ and $R_{12}$ each represents hydrogen, an alkyl group containing from 1 to 20 carbon atoms, an alkenyl group, a phenyl group or an aralkyl group; and X represents an anion; and p and q each is 0 or 1.

11. The diffusion transfer photographic film unit as claimed in claim 10, wherein $R_7$ represents hydrogen or an alkyl group containing 1 to 4 carbon atoms and Q represents —COOM, —$NH_2$ or —$SO_3M$.

12. The diffusion transfer photographic film unit as claimed in claim 11, wherein $R_7$ represents hydrogen or methyl and Q represents —COOM.

13. The diffusion transfer photographic film unit as claimed in claim 10, wherein said ethylenically unsaturated monomer is selected from acrylic acid, methacrylic acid, and the salts of these acids.

14. The diffusion transfer photographic film unit as claimed in claim 1, wherein said copolymer comprises said ethylenically unsaturated monomer containing at least one hydrocarbon group containing from 7 to 18 carbon atoms in an amount of from 90 to 10% by weight of the molecular weight of said copolymer.

15. The diffusion transfer photographic film unit as claimed in claim 1, wherein said copolymer comprises said ethylenically unsaturated monomer containing at least one hydrocarbon group containing from 7 to 18 carbon atoms in an amount of from 80 to 20% by weight of the molecular weight of said copolymer.

16. The diffusion transfer photographic film unit as claimed in claim 1, wherein said copolymer further comprises from 0 to 30% by weight of an ethylenically unsaturated monomer selected from an ester of acrylic acid, an ester of an α-alkylacrylic acid, an amide of acrylic acid, an amide of an α-alkylacrylic acid, a vinyl ester, acrylonitrile, methacrylonitrile, a diene, an aromatic vinyl compound, vinylidene chloride, a vinyl alkyl ether, ethylene, propylene, 1-butene and isobutene.

17. The diffusion transfer photographic film unit as claimed in claim 1, wherein said first peeling layer is coated in an amount of 0.001 to 1.0 g/$m^2$ and said second peeling layer is coated in an amount of 0.02 to 0.9 g/$m^2$.

18. the diffusion transfer photographic film unit as claimed in claim 17, wherein said first peeling layer is coated in an amount of 0.01 to 0.5g/$m^2$ and said second peeling layer is coated in an amount of 0.05 to 0.6 g/$m^2$.

19. The diffusion transfer photographic film unit as claimed in claim 1, wherein said cellulose ester is selected from cellulose triacetate, cellulose diacetate, cellulose propionate and cellulose acetate butyrate.

20. The diffusion transfer photographic film unit as claimed in claim 2, wherein said alkaline processing solution comprises a light screening agent in amount sufficient to shield said light-sensitive silver halide emulsion layer from daylight during processing.

* * * * *